US012162655B2

(12) United States Patent
Thompson

(10) Patent No.: US 12,162,655 B2
(45) Date of Patent: Dec. 10, 2024

(54) TEAR STRIP FOR SECONDARY PACKAGES

(71) Applicant: ANHEUSER-BUSCH INBEV S.A., Brussels (BE)

(72) Inventor: Keenan Thompson, Leuven (BE)

(73) Assignee: ANHEUSER-BUSCH INBEV S.A., Brussels (BE)

( * ) Notice: Subject to any disclaimer, the term of this patent is extended or adjusted under 35 U.S.C. 154(b) by 135 days.

(21) Appl. No.: 17/442,004

(22) PCT Filed: Mar. 26, 2020

(86) PCT No.: PCT/EP2020/058505
§ 371 (c)(1),
(2) Date: Sep. 22, 2021

(87) PCT Pub. No.: WO2020/193691
PCT Pub. Date: Oct. 1, 2020

(65) Prior Publication Data

US 2022/0161962 A1 May 26, 2022

(30) Foreign Application Priority Data

Mar. 26, 2019 (BE) ..... 2019/5189

(51) Int. Cl.
*B65D 5/54* (2006.01)

(52) U.S. Cl.
CPC ..... *B65D 5/542* (2013.01); *B65D 5/54* (2013.01)

(58) Field of Classification Search
USPC ..... 229/237
See application file for complete search history.

(56) References Cited

U.S. PATENT DOCUMENTS 776,042 A 11/1904 Acheson
2,706,076 A 4/1955 Guyer
(Continued)

FOREIGN PATENT DOCUMENTS

CN 1756820 A 4/2006
CN 205087244 U 3/2016
(Continued)

OTHER PUBLICATIONS

English translation of Chinese Patent Office Action for Application No. 2020800384151, dated Jul. 27, 2023 (14 pages).
(Continued)

*Primary Examiner* — Nathan J Newhouse
*Assistant Examiner* — Phillip D Schmidt
(74) *Attorney, Agent, or Firm* — ARENTFOX SCHIFF LLP

(57) ABSTRACT

The present disclosure provides a tear strip (100, 200) formed onto one or more wall panels (190) of a packaging blank (290) is provided. The tear strip includes one or more tear lines (110) configured onto at least one of the wall panels of the packaging blank and adapted to be cut therethrough. Each of the one or more tear lines includes a first line of weakness (111) extending longitudinally between a proximal end towards a distal end and extends to a depth generally equal to an entire thickness of the packaging blank at the first line of weakness. The tear line further includes a second line of weakness (115) extending generally diagonally away from the first line of weakness in a direction away from a center of the tear strip and towards the distal end of the wall panel. The second line of weakness extends to a depth lesser than the entire thickness of the packaging blank. In operation, the tear strip may torn by pulling the one or more tear lines together such that a generally clean cut through a cross-section of the packaging blank is achieved
(Continued)

at each of the first line of weakness and the second line of weakness.

7 Claims, 12 Drawing Sheets

(56) References Cited

U.S. PATENT DOCUMENTS

| | | | | |
|---|---|---|---|---|
| 3,076,590 | A * | 2/1963 | Petryk | B65D 5/5425 229/160.1 |
| 3,235,167 | A | 2/1966 | Svensson | |
| 3,326,369 | A | 6/1967 | Tolaas et al. | |
| 3,410,476 | A | 11/1968 | Buttery | |
| 3,669,251 | A | 6/1972 | Phillips, Jr. | |
| 3,850,363 | A | 11/1974 | Jacobs | |
| 4,511,042 | A * | 4/1985 | Wischusen, III | B65D 5/064 229/122 |
| 4,621,736 | A | 11/1986 | Roccaforte | |
| 4,634,007 | A * | 1/1987 | Rusnock | B65D 5/545 229/940 |
| 5,198,276 | A * | 3/1993 | Nakajima | B65D 75/5805 428/43 |
| 5,330,099 | A * | 7/1994 | Beales | B65D 5/443 229/160 |
| 5,542,598 | A | 8/1996 | Capo | |
| 5,722,584 | A | 3/1998 | Fujiwara | |
| 8,959,877 | B2 * | 2/2015 | Maki | B65D 5/542 493/63 |
| 9,938,039 | B2 * | 4/2018 | Nishikawa | B65B 7/16 |
| 10,494,168 | B2 | 12/2019 | Bray et al. | |
| 10,954,026 | B2 * | 3/2021 | Simpkins | B65D 5/541 |
| 2004/0071940 | A1 | 4/2004 | Frey | |
| 2005/0109827 | A1 * | 5/2005 | Martin | B65D 5/5435 229/232 |
| 2014/0238882 | A1 * | 8/2014 | Requena | B65D 71/34 493/63 |
| 2017/0267395 | A1 * | 9/2017 | Kansburg | B65D 5/5445 |

FOREIGN PATENT DOCUMENTS

| | | | | |
|---|---|---|---|---|
| JP | H08253238 | A | 10/1996 | |
| JP | 2014-046976 | A | 3/2014 | |
| JP | 2016124600 | A | 7/2016 | |
| JP | 2018-131216 | A | 8/2018 | |
| WO | WO-2018207814 | A1 * | 11/2018 | B65D 5/54 |

OTHER PUBLICATIONS

International Search Report and Written Opinion for Application No. PCT/EP2020/058505 dated Jun. 4, 2020 (9 pages).

International Preliminary Report on Patentability for Application No. PCT/EP2020/058505 dated Oct. 7, 2021 (7 pages).

Belgian Patent Office Search Report and Written Opinion for Application No. 201905189 dated Dec. 10, 2019 (9 pages, statement of relevance included).

Office Action received for Chinese Patent Application No. 202080038415.1, mailed on Feb. 21, 2024, 14 pages (7 pages of English Translation and 7 pages of Original Document).

* cited by examiner

METHOD 600

TEAR STRIP FOR SECONDARY PACKAGES

CROSS REFERENCE TO RELATED APPLICATIONS

This application is a national stage filing under 35 U.S.C. § 371 of International Patent Application No.: PCT/EP2020/058505, filed Mar. 26, 2020, which claims priority to Belgian Patent Application No. 2019/5189, filed Mar. 26, 2019, the entire contents of both of which are hereby incorporated by reference herein.

TECHNICAL FIELD

The present disclosure generally relates to secondary packages and more particularly, to a tear strip formed integrally within a secondary package.

BACKGROUND

In the sector of secondary packaging for consumer products, there has been a growing focus on easy opening of a secondary packaging, and in addition towards improvement of secondary packages such that they may serve as product display as well. This is generally achieved by designing secondary packages in such a way that they can be separated into two separate portions, removing an e.g. an upper portion, leaving a tray-like lower portion holding and displaying the products shipped within the secondary package. Therefore, when such a secondary package is opened and placed at a display shelf of a retail store, the products are directly displayed and may be sold individually directly from the display portion of the secondary package.

Numerous mechanisms have been developed particularly for facilitating conversion of such secondary packages into product displays without adversely impacting their capability of comfortable shipment.

One such mechanism, as conventionally performed, includes circumferentially slicing a carton's sidewalls along a dotted or dashed line with a knife, razor, or other sharp instrument. However, such a mechanism is not preferred due to safety concerns, posing a real risk of injury to a user slicing the carton. Further, the use of knife may damage the product stored within the carton if it comes into contact therewith. Additionally, the knife blade tends to leave non-uniform wavy or ragged edges which is not aesthetically preferred.

Therefore, there is a demand for easy and safe opening of shipping packages having a tear string, tear tape, or other tear strip which, when pulled through the outer wall of a shipping package, leaves a separated display portion, having enhanced display aesthetics and sale of the products displayed therewith.

U.S. Pat. No. 3,850,363, discloses a shipping carton having a tear string circumferentially attached to an interior surface of the carton's side walls. Pulling the tear strings tears the carton's side walls and separates the carton into a top section and a bottom section. However, with such tear strings a very large pulling force is needed to split the carton walls. This could be overcome by a mechanism as disclosed in U.S. Pat. No. 4,621,736 which provides a paperboard carton having a tear string attached to an inside liner of the carton wall. Further, partial cuts are made in an outer liner of the carton material. The tear string, when drawn through the carton wall, divides the carton into a lid and a container portion. However, the cuts in the outer liner weakens the strength of the carton.

In other instances, two half portions of the cartons, when mated, form an enclosed interior and are joined together using various kind of adhesive tear patches. These patches when pulled away, divides the carton into separate portions. In some instances, various kind of adhesive tear strips were utilized. An adhesive tear strip is usually formed from a paperboard carton material, connected to an adhesive strip which, in turn, is adhesively affixed to the wall of a carton. Further, severance lines are provided at the contact portion of the carton wall, intended to provide a means for clean separation and removal of the tear strip as the carton is opened. To open the package, the tear seal member is pulled away from the slot. In practice, however, these adhesive strips seldom provide a clean tear and peel off a portion of the underlying panel attached to the tear strip. Additionally, such cartons are very weak and therefore vulnerable of getting distorted during stacking and/or transportation. Moreover, the utilization of a separate adhesive panel and a separate detachable tear strip adds materially to the cost of the carton.

As an alternative to these tear strings and/or adhesive patches, the walls of the carton material may be cut along a pair of spaced, parallel lines to thereby form a tear strip from the material of carton itself. Various kind of tear strip means for opening cartons and the like, are known in the prior art, for example, U.S. Pat. Nos. 2,706,076; 3,235,167; 3,326,369; U.S. Pat. No. 776,042; U.S. Pat. No. 3,669,251 among others, disclosing various kind of tear strips formed by a pair of spaced apart, generally parallel perforated lines of weakness, which extend longitudinally across the carton walls, and which when torn, divides the carton in two parts. However, such perforated lines of weakness, render these walls vulnerable to rupture and therefore results in weakened package structures which inadequately protect its contents.

Accordingly, considerable efforts have yet been imparted in producing a secondary package with a removable tear strip having lines of weakness suitable to be easily removed while at the same time preventing the weakening of the carton and accidental opening thereof. Most of the attempts made to overcome this difficulty have primarily been focused on the use of a thicker/multi-layer carton material. However, a small increase in thickness has been found to be ineffective, and a large increase has been found to be prohibitively expensive.

U.S. Pat. No. 3,410,476, discloses an improved design of tear strips wherein a cut score line is provided alongside a severance line which further comprises a plurality of discontinuous slits, each slit having a portion not collinear with the other slits. While generally satisfactory, such tear strips tend to collapse inwardly along the severance line upon handling of the cartons, particularly in automatic carton erecting machines.

JP H08 253238 discloses a tear strip configured on one or more wall panels of a packaging container, wherein the tear strip comprises one or more tear lines adapted to be cut through at least one of the wall panels, in which each of the tear lines comprises: a first line of and a second line of weakness, where the weakening extends through part of the cross-section of the packaging container. However, tearing this tear strip does not necessarily result in a smooth cut in the packaging container.

Further, it is recognized in the state of the art, that multilayer carton packaging, and especially when wet, suffer from deviating and ugly tearing off where in some case parts of layers of the multilayer carton at the outer edges of the tear strip (outside the tear strip area) is removed together with the tear strip.

As can be seen from the foregoing discussion, there still exists a need for a further improved tear strip which, while being cost efficient, resists inward and outward collapse, is reinforced, and provides a relatively higher tensile strength while at the same time assuring quick, clean and safe tear for opening of the carton.

SUMMARY

In one aspect of the present disclosure, a tear strip formed onto one or more wall panels of a packaging blank is provided. The tear strip includes one or more tear lines configured onto at least one of the wall panels of the packaging blank packaging blank and adapted to be cut there-through. Each of the one or more tear lines includes a first line of weakness extending longitudinally between a proximal end towards a distal end and extending to a depth equal to an entire thickness of the packaging blank. The tear line further includes a second line of weakness extending generally diagonally away from the first line of weakness in a direction away from a center of the tear strip and towards the distal end of the wall panel. The second line of weakness extends through only a part of the depth of the cross-section of the corresponding blank. I.e. it extends to a depth lesser than the entire thickness of the packaging blank. In operation, the tear strip is torn by pulling the one or more tear lines together (e.g. by a pull tab) such that a generally clean cut through a cross-section of the packaging blank is achieved at each of the first and second lines of weakness. It was found that in particular such a second line of weakness through a part of the depth of the cross-section of the blank results in a clean tearing off. This is particularly achieved by redirecting any tearing off, deviating from the first line of weakness, back towards the original first line of weakness' orientation. In other words, the second line of weakness intercepts any deviating tearing off and redirects it again towards the first line of weakness. This is particularly beneficial for use in multilayer carton packaging, and especially when wet. As particularly advantageous, each of the tear lines of the tear strip is formed of a first full-cut-through line of weakness extended with a second partial-cut-through line of weakness. Such a design, while being stronger, is resistant to rough conditions and therefore self-rupturing is avoided. Furthermore, such a design provides a smooth cut and reduces the possibility of flying away of blank particles and delamination of the secondary package during the tearing operation.

Generally, the tear strip formation is integrated in the manufacture of the packaging blank at a step of die-cut.

Alternatively, the tear strip may be formed separately from the (foldable) blank and mounted on the packaging blank after the blank is manufactured and adapted to be folded to form a generally carton shaped secondary package.

Preferably, the first line of weakness includes a first portion extending generally parallel to a longitudinal axis of the tear strip and a second portion extending diagonally away from the first portion in a direction towards the center of the tear strip.

Further optionally, the first and second portions of the first line of weakness and the second line of weakness meet at a point of contact $C_M$.

Optionally, the packaging blank may be made of a material selected from one or more of but not limited to all kind of papers, paperboard, fiberboard, cardboard, corrugated board, laminated board, hybrid material, fabrics, plastics, metal plate and the like.

Advantageously, the tear strip has a double row of tear lines put in place, particularly in parallel. Further optionally, in a double row of tear lines, an imaginary axial line LF, along the second portion of the first line of weakness of the first tear line intersects with an imaginary axial line $L_{F2}$ along the second portion of the first line of weakness of the second parallel adjacent tear line on an axial line $L_C$ of a center point of the tear strip.

Yet further Optionally, in a double row of tear lines, an imaginary axial line Ls, corresponding to the second line of weakness of the first tear line intersects with an imaginary axial line $L_{S2}$ corresponding to the second line of weakness of the second tear line on an axial line $L_C$ at the center point of the tear strip.

Optionally, each of the one or more tear lines includes two or more first lines of weakness, each extended towards a corresponding second line of weakness.

Further optionally, each of the second lines of weakness of the first tear line, in a double row configuration, is of a thickness about same as that of each of the second line of weakness of the second tear line in the same double row configuration and extends to a depth between 25% and 75% of the thickness of the wall panel of the packaging blank, or between 40% and 60%, or between 45% and 55% and preferably about half (50%) of the thickness of the wall panel of the packaging blank.

Particularly, the first line of weakness is generally a groove or incision formed by cutting the blank material to a depth across the entire thickness of the blank; i.e. fully cut-through.

Further, the second line of weakness is generally a groove or incision formed by cutting the blank material to a depth across any part of the cross-section of the blank; i.e. not fully cut-through Optionally, the tear strip includes a barrier layer coated onto the top of each of the first and second lines of weakness.

In another aspect of the invention, a method for manufacturing a secondary package comprising a tear strip adapted to provide a smooth and clean tear is provided. The method includes providing a blank for a secondary package;

creating one or more tear lines, each tear line made up of a series of consecutive first and second lines of weakness respectively extending fully or partially cut-through the blank's cross sectional thickness, such that when the tear strip is torn, for example by pulling a pull tab, a generally clean cut through the cross-section of the packaging blank is achieved at each of the first line of weakness and the second line of weakness and thereby separating the final package in two separated portions.

Generally, the method includes formation of one or more tear strips onto the one or more walls of the secondary package.

Optionally, the method includes an additional step of coating each of the first and second lines of weakness in a tear line with a material of barrier layer to avoid any possible contamination of dust, moisture, or the like from entering the secondary package through the lines of weakness.

Further optionally, the barrier layer material may be selected from one or more of, but not limited to, a layer of material that suitably minimizes the transmission of water, air, and other vapors there through as required by a particular application. For instance, the barrier layer may include material selected from one or more of, but not limited to, PVC, polyethylene terephthalate, polyvinyl alcohol; colloidal silica, polyvinylidene chloride, a styrene-acrylic polymer, ethylene acrylic acid polymer, a wax, and colloidal silica; and/or any combination thereof.

Preferably, the first and second lines of weakness constituting a tear line, may be formed using any mechanical mechanism conventionally known in the art.

Further optionally, the mechanical mechanism for forming the first and second lines of weakness constituting a tear line, is selected from one or more of, but not limited to, grooving, scoring, cutting, punching, carving, perforation, and the like.

In another aspect of the invention, a secondary package having one or more tear strips each having one or more tear lines is provided. The secondary package includes a plurality of walls including a top wall, a bottom wall and a plurality of sidewalls defining an inner surface therewithin. The secondary package further includes one or more tear strips configured thereon adapted to be torn/pulled away resulting in a clean cut across the cross section thereby providing an access within the container there through.

Generally, the secondary package is formed of a material selected from but not limited to a packaging blank, paperboard, a cardboard, plastic, paper, hybrid material, and any combination thereof.

Alternatively, the secondary package may be an envelope formed of a material selected from but not limited to a paperboard, a cardboard, plastic, paper, hybrid material, and any combination thereof.

Advantageously, the secondary package may be of any suitable geometric shape such as cuboidal, cubical, spherical, circular, organic and the like.

The details of one or more implementations are set forth in the accompanying drawings and the description below. Other aspects, features and advantages of the subject matter disclosed herein will be apparent from the description, the drawings, and the claims.

DETAILED DESCRIPTION

Figure 1A:
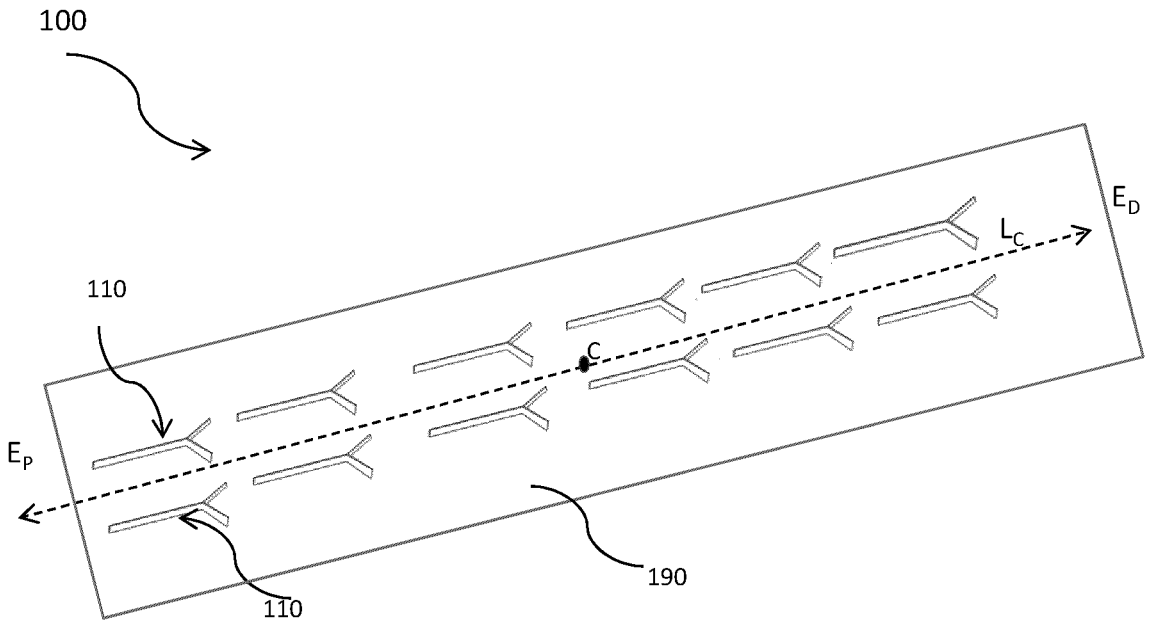
FIG. 1*a* illustrates a schematic diagram representing a tear strip, in accordance with a preferred embodiment of the present disclosure.
Figure 1B:
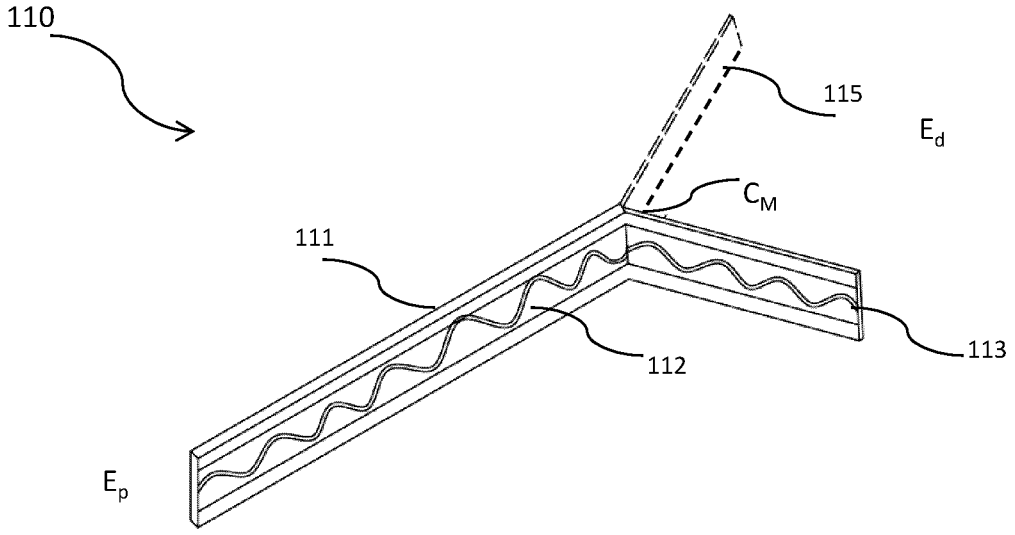
FIG. 1*b* illustrates a schematic diagram representing a tear line, in accordance with a preferred embodiment of the present disclosure.

FIG. 1 illustrates a schematic diagram displaying basic components of the tear strip of the present disclosure. As illustrated in FIGS. 1*a* and 1*b*, the present disclosure provides a tear strip 100 adapted to be configured within with one or more wall panels 190, of a packaging blank [not shown] adapted to form a secondary package [not shown] for holding a plurality of items such as beverage containers, food items, house hold essentials, and the like. The tear strip 100 includes one or more tear lines 110. As illustrated in FIG. 1*b*, the tear line 110 includes a first line of weakness 111 extending longitudinally away from a proximal end $E_p$ towards a distal end $E_d$. The first line of weakness 111 includes a first portion of weakness 112 extending generally parallel to a central longitudinal axis $L_C$ passing through a center point C of the tear strip 100. The first line of weakness 111 further includes a second portion of weakness 113 extending diagonally away from the first portion of weakness 112 from a point of contact $C_M$. and extends in a direction towards the central longitudinal axis $L_C$ of the tear strip 100. The first line of weakness 111 including the first portion of weakness 112 and the second portion of weakness 113 extends to a depth generally equal to an entire thickness of the wall panel 190. The tear line 110 further includes a second line of weakness 115 extending away from first line of weakness 111 at the point of contact $C_M$ and in a direction away from the central longitudinal axis $L_C$ of the tear strip 100. The second line of weakness 115 extends to a depth generally lesser than the entire thickness of the wall panel 190. In operation, when a user pulls the one or more tear lines 110 together, the tear strip 100 is torn away in such a way that a generally clean cut through a cross-section of the wall panel 190 is achieved at each of the first line of weakness 111 and the second line of weakness 115.

The tear strip 100 of the current disclosure is generally adapted to be configured within one or more walls of a secondary package holding a plurality of items, either as a multipack or as a group of items packed together in such a way that either the secondary package is separated into two parts, or otherwise provides an access therewithin an interior portion thereof.

Figure 2A:
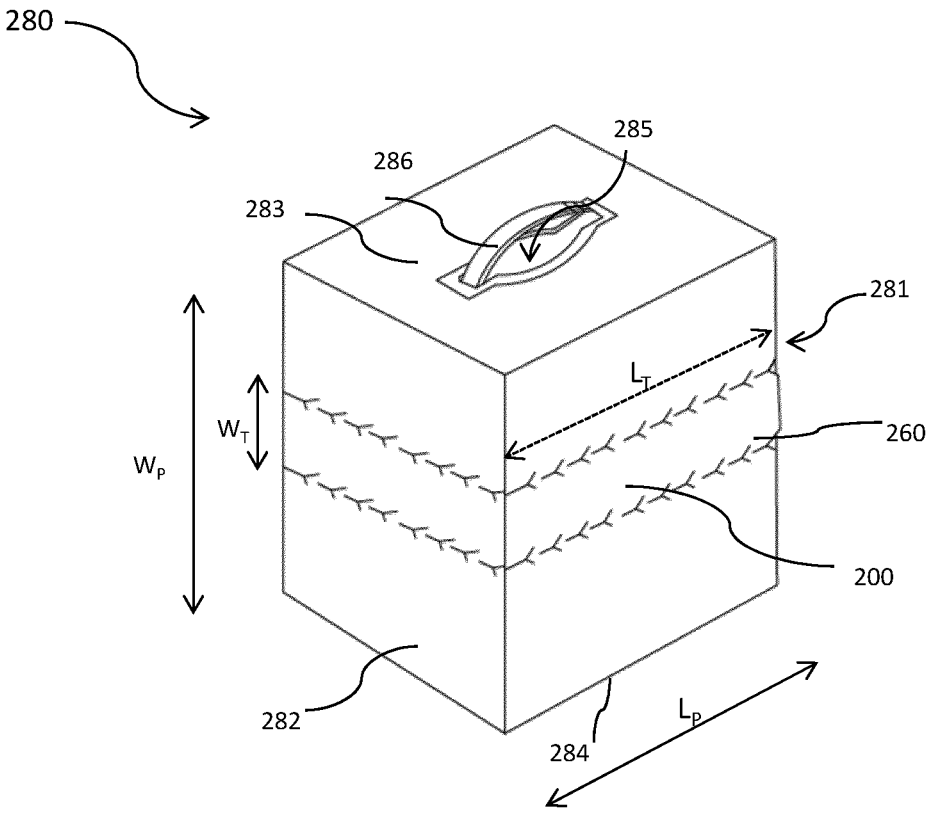
FIG. 2*a* illustrates a schematic diagram representing an exemplary secondary package having a tear strip, in accordance with a preferred embodiment of the present disclosure.
Figure 3A:
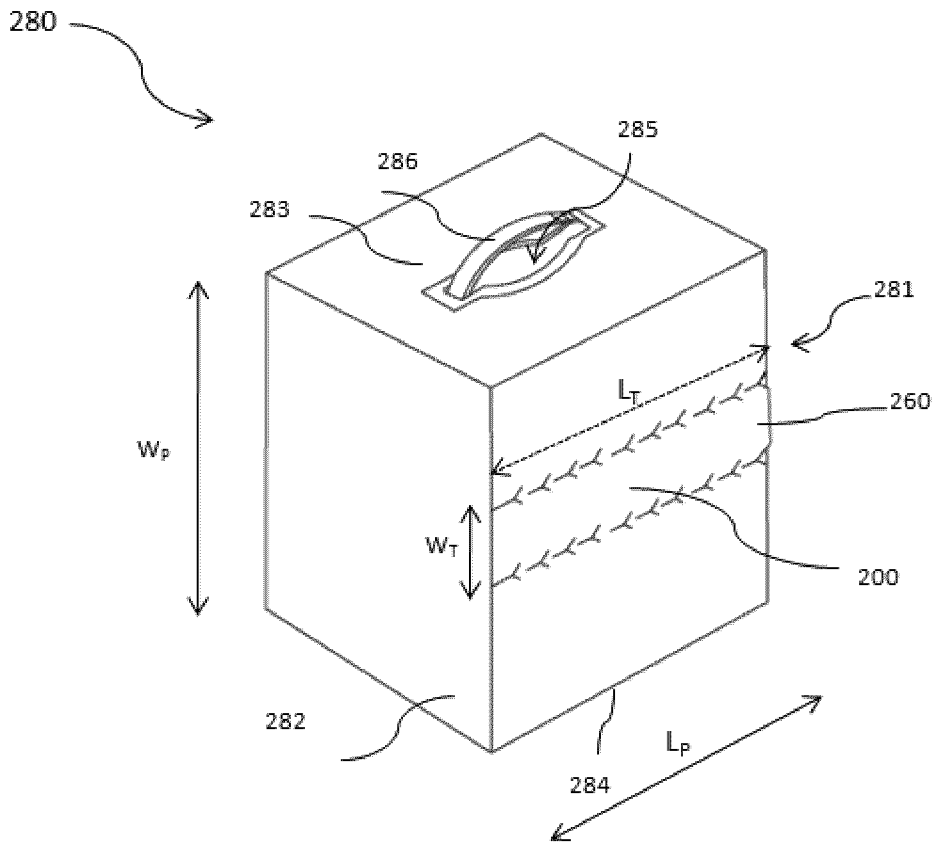
FIG. 3*a* illustrates a schematic diagram representing an exemplary secondary package having a tear strip, in accordance with another embodiment of the present disclosure.
Figure 3B:
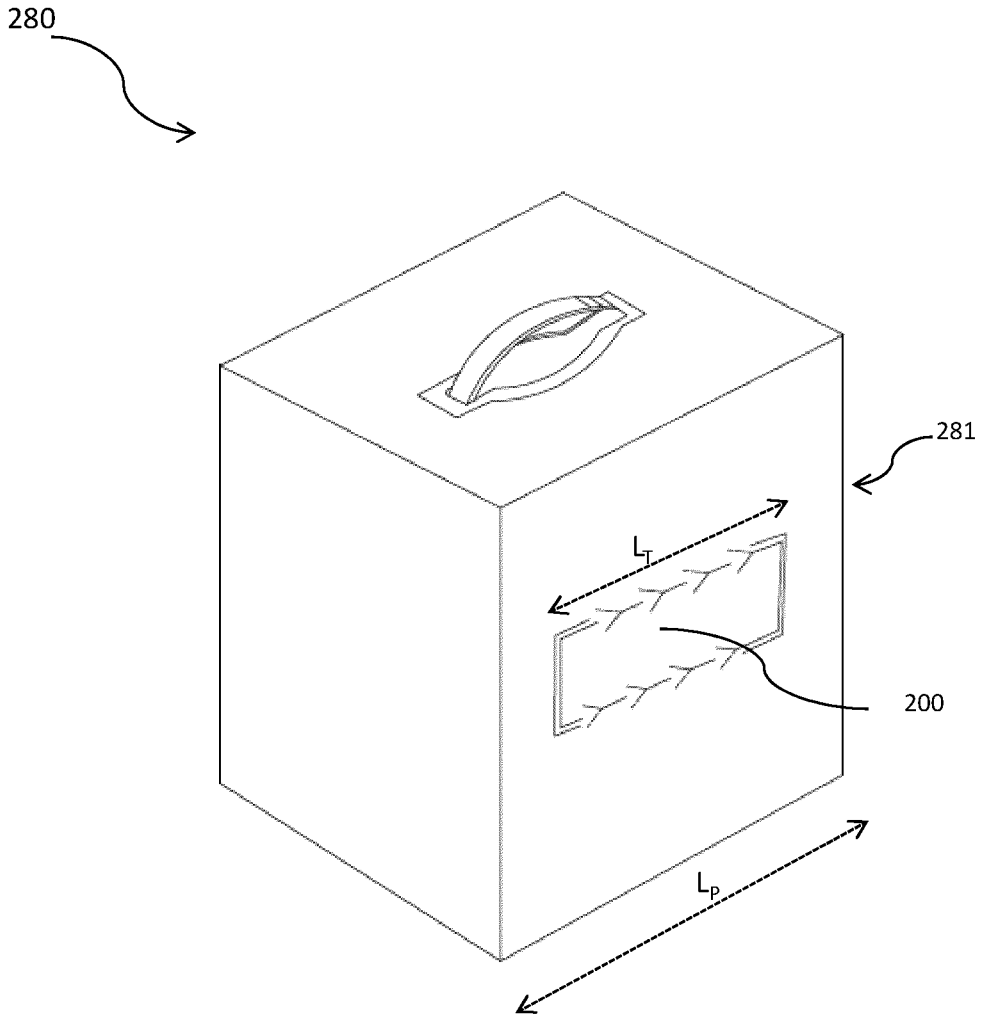
FIG. 3*b* illustrates a schematic diagram representing an exemplary secondary package having a tear strip, in accordance with yet another embodiment of the present disclosure.
Figure 3C:
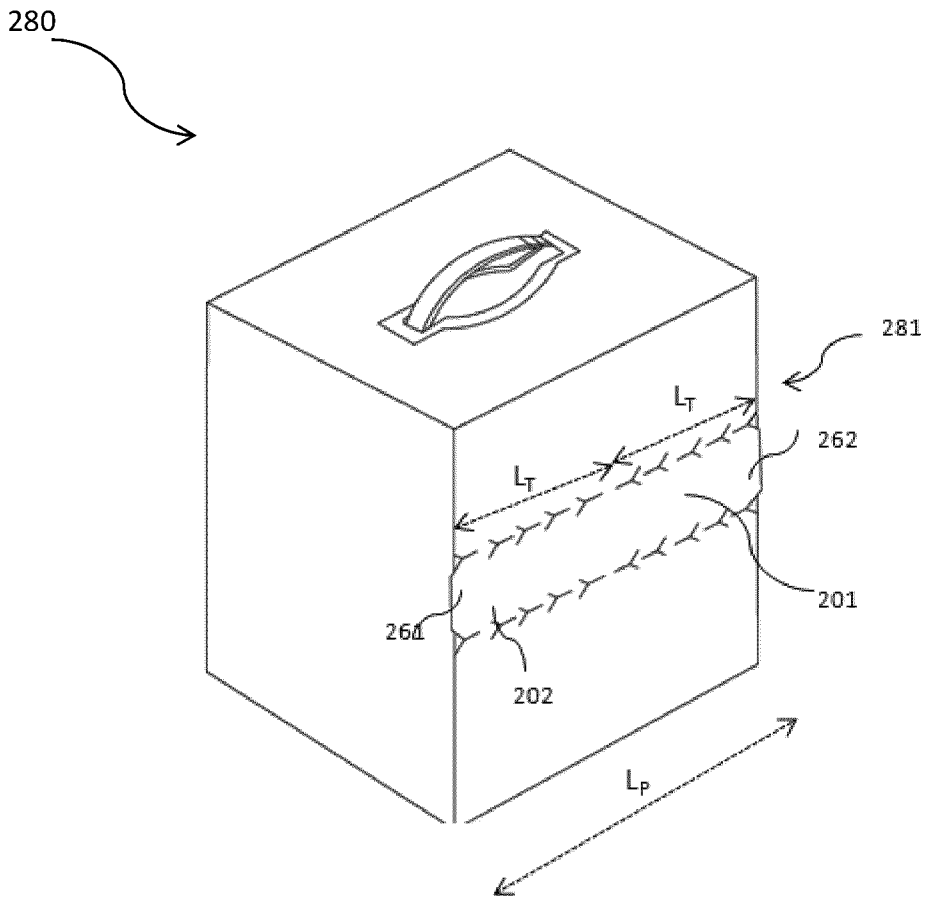
FIG. 3*c* illustrates a schematic diagram representing an exemplary secondary package having a tear strip, in accordance with yet another embodiment of the present disclosure.
Figure 4A:
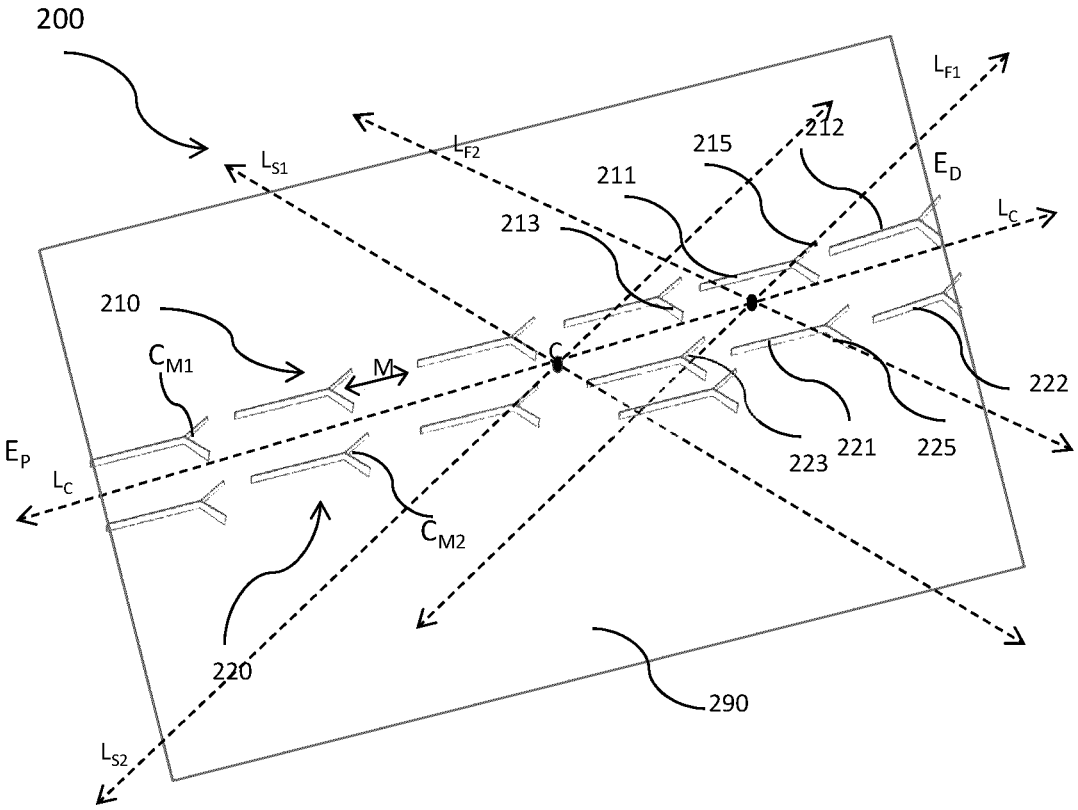
FIG. 4*a* illustrates a schematic diagram representing a tear strip configured onto a packaging blank, in accordance with a preferred embodiment of the present disclosure.
Figure 4B:
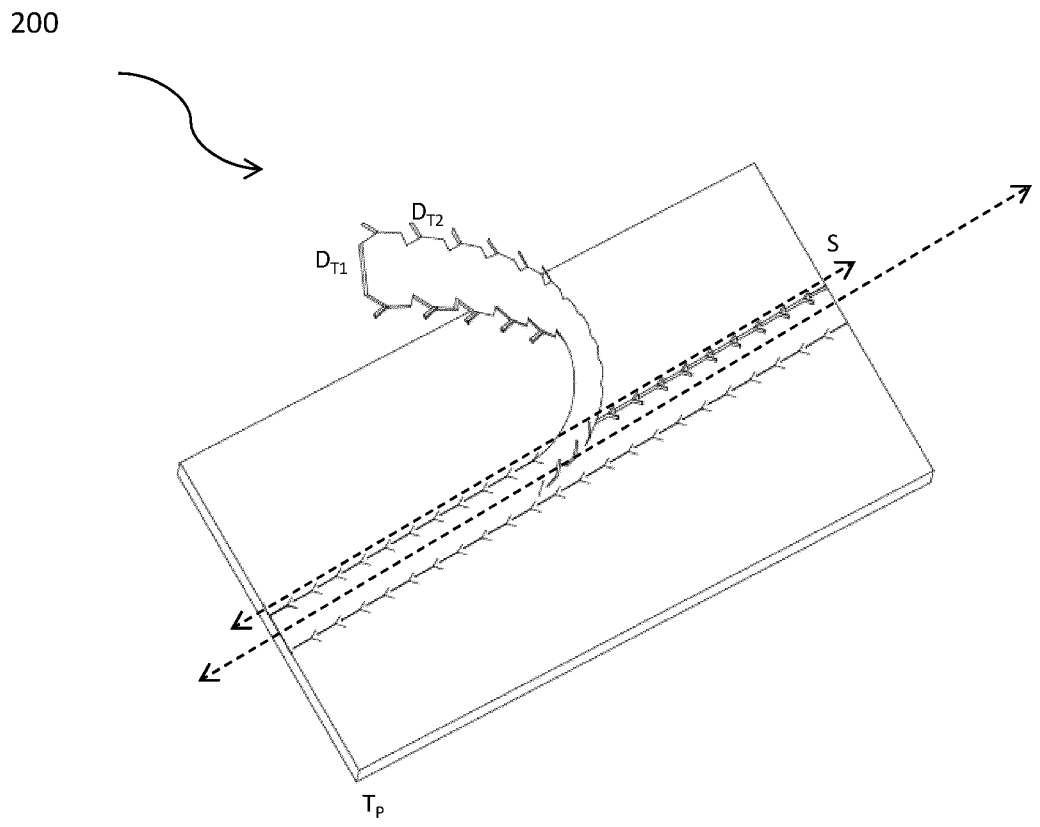
FIG. 4*b* illustrates a schematic diagram representing tearing of the tear strip, in accordance with a preferred embodiment of the present disclosure.

In description of the FIGS. 2-4 that follow, elements common to the schematic system will have the same number designation unless otherwise noted. In a first embodiment, as illustrated in FIG. 2*a*, a secondary package 280 employing a tear strip 200 is provided. In a preferred embodiment, secondary package 280 includes a housing 281 formed of a packaging blank [not shown] having one or more wall panels defining a plurality of sidewalls 282 extending between a top wall 283, and a bottom wall 284, defining an inner surface 285 therewithin. The housing 281 further includes one or more handle 286. While the exemplary embodiments disclose the handle 286 configured onto the top wall 283, it should be contemplated for a person skilled in the art that the handle may be configured within any of the one or more of plurality of walls 282 and/or the top wall 283 and/or the bottom wall 284. The tear strip 200 is generally adapted to be configured within at least one of the sidewalls 282 such that when torn away, it provides at least a visible access to the inner surface 285 therethrough.

Accordingly, the tear strip 200 is generally configured at an elongated portion of one of the sidewalls 282, having a length $L_T$ generally equal to a Length $L_P$ and a width $W_T$ generally lesser than a width $W_P$ of the corresponding sidewall 282. However, in other embodiments of the present invention, the tear strip 200 may be shaped into any desired dimension and may also depend upon the design constraints related thereto, which will be discussed later.

In a preferred embodiment, the housing 281 is generally formed from a folded blank [not shown] for holding a plurality of generally cylindrical shaped beverage containers. Further, the shape and size, including the height of the housing 281 may be varied depending on the design constraints and requirements for its application. For example, within the instances when the housing 281 is adapted to house twelve containers in one layer in a 3×4 arrangement the housing is dimensioned accordingly. Further, in other instances, the housing may be sized and shaped to hold containers of a different or same quantity in a single layer, more than two layers, and/or in different row/column arrangements (e.g., 1×6, 3×6, 2×6, 4×6, 2×3×4, 2×6×2, 2×9, 3×5, 3×5×2, etc.).

While the secondary package 280 has been displayed as a housing box 281 as an exemplary embodiment, it should be understood that the secondary package 280 may be formed in any desired shape such as various differently shaped containers, spherical holders, circular boxes, and may be from any desired material such as including all kind of papers, fiberboard, corrugated board, plastic, hybrid material, or any combinations thereof. Similarly, when adapted to hold different items, the housing 281 is sized and dimension accordingly depending upon the size and dimension requirements of the corresponding items.

As illustrated in FIG. 4*a*, the tear strip 200 includes a first tear line 210 spaced apart from a second tear line 220 at a distance defined by the width $W_T$ of the tear strip 200. The first tear line 210 includes a plurality of first lines of weakness 211, each extended towards a second line of weakness 215, between a proximal end $E_p$ and towards a distal end $E_D$. Each of the first line of weakness 211 includes a first portion of weakness 212 extending generally parallel to a central longitudinal axis $L_C$ passing through a center point C of the tear strip 200. The first line of weakness 211 further includes a second portion of weakness 213 extending diagonally away from the first portion of weakness 212 of the first tear line 210 from a first point of contact $C_{M1}$, and extends in a direction towards the central longitudinal axis $L_C$ of the tear strip 200. The first line of weakness 211 of the first tear line 210 is further extended towards the corresponding second line of weakness 215 of the first tear line 210, and extending away from the first point of contact $C_{M1}$ and in a direction away from the central longitudinal axis $L_C$ of the tear strip 200.

Further, the second tear line 220 includes a plurality of first lines of weakness 221, each extended towards a second line of weakness 225, between a proximal end $E_p$ and towards a distal end $E_D$. Each of the first line of weakness 221 of the second tear line 220 includes a first portion of weakness 222 extending generally parallel to the central longitudinal axis $L_C$ of the tear strip 200. The first line of weakness 211 of the second tear line 220 further includes a second portion of weakness 213 extending diagonally away from the first portion of weakness 212 of the second tear line 220 from a second point of contact $C_{M2}$. and extends in a direction towards the central longitudinal axis $L_C$ of the tear strip 200. The first line of weakness 221 of the second tear line 220 is further extended towards the corresponding second line of weakness 225 of the second tear line 220 extending away from the first point of contact $C_{M2}$ and in a direction away from the central longitudinal axis $L_C$ of the tear strip 200

Figure 5A:
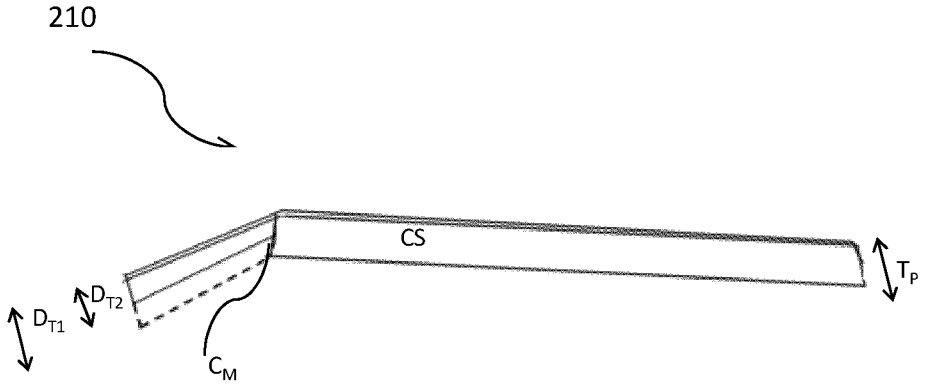
FIG. 5*a* illustrates a schematic diagram representing a cross-sectional view of a tear line, in accordance with an exemplary embodiment of the present disclosure.

In a preferred embodiment, as illustrated in FIG. 5*a*, the plurality of first lines of weakness 211 of the first tear line 210 including each of the first portion of weakness 212 and each of the second portion of weakness 213 extends to a depth $D_{T1}$ generally equal to an entire thickness $T_P$ of the wall panel 190. Further, the plurality of first line of weakness 221 of the second tear line 220 including each of the first portion of weakness 222 and each of the second portion of weakness 223 extends to a depth generally same as depth $D_{T1}$ and equal to the entire thickness $T_P$ of the sidewall 282. However, in other embodiments, the depth of the second portion of weakness 223 and the depth $D_{T1}$ may be lesser than but about similar to the thickness $T_P$ of the sidewall 282.

Figure 5B:
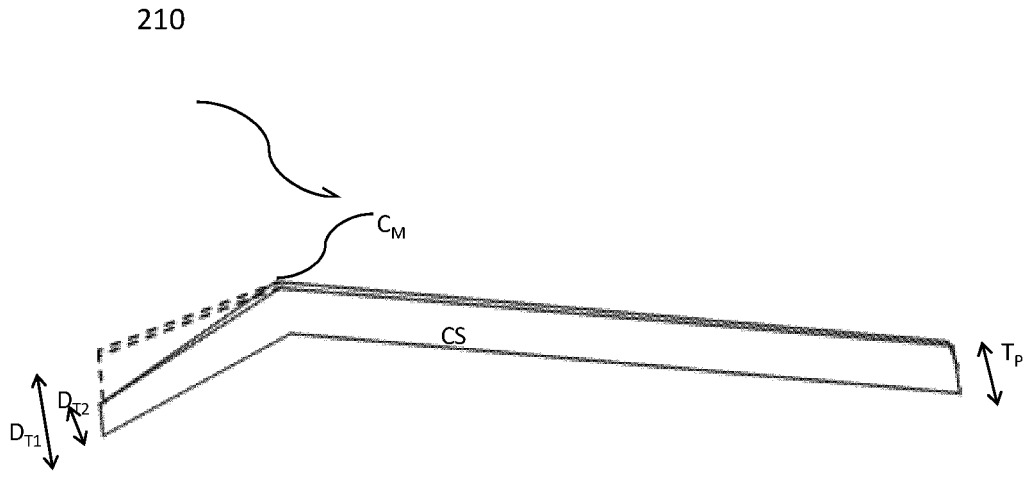
FIG. 5*b* illustrates a schematic diagram representing a cross-sectional view of a tear line, in accordance with another exemplary embodiment of the present disclosure.

Further in the preferred embodiment, the plurality of second line of weakness 215 of the first tear line 210 and the plurality of second line of weakness 225 of the second tear line 220 extends to a depth $D_{T2}$, generally lesser and preferably about half to the entire thickness $T_P$ of the sidewall 282. In some other embodiments of the present invention as illustrated in FIG. 5*b*, the depth $D_{T2}$ is a constantly decreasing from the respective point of contacts $C_M$ towards an end point of each the second line of weakness 215 and 225 respectively. Such an embodiment further enables a smooth transition from the first lines of weakness 211, 221 towards the corresponding second lines of weakness 215, 225 respectively.

In some preferred embodiments, an axial line $L_{F1}$ of the second portion of weakness 213 of the first tear line 210 when extended towards the center of the tear strip 200 intersects with an axial line $L_{F2}$ of the second portion 223 of the first line of weakness 221 of the second tear line 220 at the axial line $L_C$ of the center point C of the tear strip 200. Further in such embodiments, in preferred instances, an axial line $L_{S1}$ of the second line of weakness 215 of the first tear line 210 when extended towards the center of the tear strip 200 intersects with an axial line $L_{S2}$ of the second line of weakness 225 of the second tear line 220 at the axial line $L_C$ of center point C of the tear strip 200. Such a configuration as disclosed above provides high mechanical strength to the tear strip 200 while being easy to tear away from the housing 281.

The first lines of weakness 211, 221 including the first portions 212, 222 and the second portions of weakness 213, 223 of each of the first tear line 210, and the second tear line 220 is generally formed of a slit and/or groove formed within the sidewall 282/blank 290, of the housing 281, up to a predetermined depth. The predetermined depth is generally the entire thickness $T_P$ of the sidewall 282/blank 290, of the housing 281. In a preferred embodiment, the first line of thickness 211 is a single groove/slit across its length. However, in other embodiments, the first line of weakness 211 is a combination of plurality of small perforations across its length.

In some embodiments, the first line of weakness 211, 221 is formed by removing housing material using one or more suitable mechanically mechanisms/tools such as a grooving channel, grooving tools, or the like, for forming grooves/perforations, and conventionally known in the art. However, in some preferred embodiments, the first line of weakness 211, 221 is formed during the process of die-cutting the blank 290 of the corresponding housing 281. In yet other embodiments, the first line of weakness 211, 221 is formed by burning away the carton material up to the predetermined depth by means of laser radiations, or the like.

The second line of weakness 215, 225 of each of the first tear line 210, and the second tear lines 220 is generally formed of a slit and/or groove formed within the sidewall 282/blank 290, of the housing 281, up to a predetermined depth. The predetermined depth is generally a part of the thickness and preferably, half of the entire thickness $T_P$ of the sidewall 282/blank 290, of the housing 281. In a preferred embodiment, the second line of thickness is a single groove/slit across its length. However, in other embodiments, the second line of weakness is a combination of plurality of small perforations. Such an embodiment with plurality of perforations facilitates controlling the separation of the tear strip 200 partially to a desired length.

The second line of weakness 215, 225 is formed by removing housing material using one or more mechanically mechanisms/tools suitable such as a grooving channel, grooving tools, or the like, for forming grooves/perforations, and conventionally known in the art. However, in preferred embodiments, the second lines of weakness 215, 225 may be formed during the process of die-cutting the blank of the corresponding housing. In yet other embodiments, the second line of weakness is formed by burning away the carton material up to the predetermined depth by means of laser radiations, or the like.

In a preferred embodiment, each of the second portions of weakness 213, 223 of respectively the first tear line 210 and the second tear line 220 is generally configured at a predetermined angle (a) [not shown] to the first portion of weakness 212 and the longitudinal axis $L_C$ of the tear strip 200. The predetermined angle (a) between each of the second portions of weakness 213, 223 and the longitudinal axis $L_C$ of the tear strip 200 generally is same such that the plurality of consecutive second portions of weakness 213 of the first tear line 210 are generally parallel to each other. Similarly, the plurality of second portions of weakness 225 of the second tear line 220 are generally parallel to each other. Additionally, the axial line $L_{F1}$ of each of the second portions of weakness 213 of the first tear line 210 meets, and generally intersects to the axial line $L_{F2}$ of each of the corresponding second portions of weakness 223 of the second tear line 220 at the central longitudinal axis $L_C$.

Further in a preferred embodiment, each of the second lines of weakness 215, 225 of respectively the first tear line 210 and the second tear line 220 is generally configured at a predetermined angle (β) [not shown], to the first portions of the respective first lines of weakness 211, 221 and the central longitudinal axis $L_C$. Preferably, the predetermined angle (β), between each of the second line of weakness 215, 225 and the longitudinal axis $L_C$ of the tear strip 200 generally is the same and is generally an obtuse angle, such that the plurality of consecutive second lines of weakness 225 of the first tear line 210 are parallel to each other. Similarly, the plurality of second line of weakness 225 of the second tear line 220 are parallel to each other. Additionally, the axial line $L_{S1}$ of each of the second line of weakness 215 of the first tear line 210 meets, and generally intersects to a to the axial line $L_{S2}$ of each of the corresponding second line of weakness 225 of the second tear line 220 at the central longitudinal axis $L_C$.

More particularly, the second portions of weakness 213, 223, and the second lines of weakness 215, 225 of each row of the tear strip 200 are directed in generally opposite directions and at the predetermined angle relative to the longitudinal axis $L_C$ of the tear strip 200. Such a divergence in the opposite direction relative to the longitudinal axis $L_C$ thereby defines the opposite directions of tear and facilitates a smooth tearing across the length of the tear strip 200, when torn away.

In an embodiment, the first lines of weakness 211, 221 in the respective tear lines, and the corresponding second lines of weakness 215, 225 are distanced from one line of weakness to the subsequent line of weakness in a same tear line by a predetermined margin M. The predetermined margin M is adapted to provide adequate strength to the carton sidewalls 282 for storage and carrying purposes. Generally, the predetermined margin M is a distance ranging between 1 mm and 10 mm. However, in other embodiments, the predetermined margin M may be any desired distance in accordance with the design as well as utility of the application. In some instances, the margin M is decided on the basis of material of the tear strip 200. For example, when the tear strip 200 is formed of a strong material which can tolerate a nick at their outer edges without slitting, fracturing, or tearing of the material when a tensile load is applied thereto, the Margin M between the consecutive sets of line of weakness of the each of the tear lines 210, 220 may be reduced as desired. In other instances, the margin M is decided on the basis of utility of the carton 281. For example, when the carton is adapted to hold a plurality of beverage cans therein, the margin M may be a distance generally corresponding to a diameter of a can to provide for the release only of the contents adjacent to the end margin M, and therefore enables a partial tearing of the tear strip 200. This is particularly suitable when the housing 281 is adapted to be used for storage purpose, and not for the display purpose.

As is now evident the tear strip 200 of the present invention is adapted to provide a line of separation S which is smooth along the longitudinal axis $L_C$ of the tear strip 200. In an embodiment of the present disclosure, a suitable material between the first tear line 210 and the second tear line 220 at one of the ends of the tear strip 200 is about raised up and therefore serves as a pull tab 260 thereof. The pull-tab 260 may be manually grasped by a user and pulled/drawn away from the housing 281. This causes the tear strip 200 to tear along the first tear line 210 and the second tear line 220 and thereby allowing the user to quickly and easily operate the tear strip 200 such that it tears evenly and completely, and desirably provides a clean edge to each separate container 286, 287 at the line of separation S.

In some embodiments, the tear strip 200 further includes a layer of barrier material [not shown] applied over the first line of weakness 211, 221 and the second line of weakness 215, 225 to prevent contamination from external environment to enter the inner surface 285 of the housing 281. The layer of barrier material may be selected from a layer of material that suitably minimizes the transmission of water, air, and other vapors there through as required by a particular application. For instance, the barrier layer may include material selected from one or more of but not limited to PVC, polyethylene terephthalate, polyvinyl alcohol; colloidal silica, polyvinylidene chloride, a styrene-acrylic polymer, ethylene acrylic acid polymer, a wax, and colloidal silica; and/or any combination thereof.

Alternatively, in some other embodiments, the tear strip 200 include a coating of barrier material applied over the first line of the weakness 211, 221 and the second line of weakness 215, 225. Such a coating of barrier material effectively seals the first and second lines of weakness 211, 221, 215, 225, without adversely affecting the ease with which the tear strip 200 may be removed.

Figure 2B:
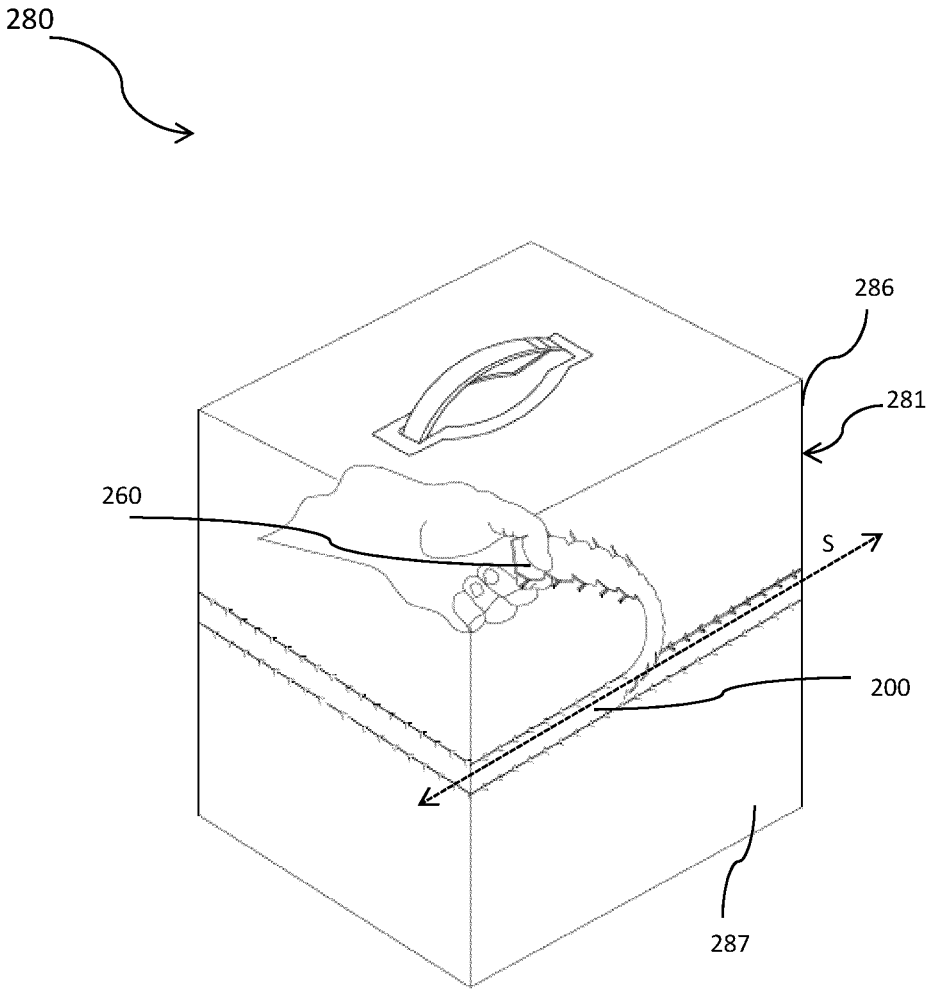
FIG. 2*b* illustrates a schematic diagram representing a tearing of the tear strip from the secondary package, in accordance with a preferred embodiment of the present disclosure

As disclosed earlier, the tear strip 200 is arranged generally on the sidewalls 282 of the housing 281, formed of the packaging blank 290. In a preferred embodiment as illustrated in FIG. 2*a*, the tear strip 200 extends around the periphery of the housing 281 to define a division line for severing the carton 281 in half thereby to afford easy access to the contents stored therein. Further in such instances, as illustrated in FIG. 2*b* the tear strip 200 facilitates a separation of the housing 281 into two or more cartons, 286, 287 once the tear strip 200 is pulled away from the housing 281, as according to the design constraints of the utility and application thereof.

In some other embodiment of the current disclosure as illustrated in FIG. 3*a*, the tear strip 200 is configured only on a single sidewall 282 thereof. Such a configuration is generally suitable in the instances where the line of separation S is provided for facilitating an access to the inner surface 285 of the housing 281. However, in such instances, the separation of the housing 281 into two parts in not possible.

Further in yet other embodiments as illustrated in FIG. 3*b*, the tear strip 200 is formed of a length $L_T$ lesser than a length $L_P$ of the sidewall 282 of the housing 281. Such an configuration is particularly suitable for instances, where the access to take out contents, such as sheets, tissues, and the like, does not require the tear strip 200 to extend to the complete length $L_P$ of the sidewall 282, and in instances, where the material of housing 281 is so week that when the complete tear strip 200 is pulled away, the sidewalls 282 of the housing 281 may get damaged.

In yet other embodiments, as illustrated in FIG. 3*c*, the housing 281 may include two or more tear strips 201, 202 of length $L_{T1}$, $L_{T2}$, respectively, on the same sidewall 282 of the housing 281 such that length $L_{T1}$, $L_{T2}$, are both individually lesser than the length $L_P$ of the sidewall 282 of the carton 281 and in combination is equal to length $L_P$ of the sidewall 282. In such embodiments, each tear strip 201, 202 may be configured within a confronting relationship, as previously described. In such instances each of the two or more tear strips 201, 202 may be pulled away independently by corresponding pull-tab 261, 262 respectively.

It is to be understood that while the current disclosure mentions an exemplary tear strip 200, the invention contemplates all other implementation possibilities thereof without deviating from the scope of the disclosure. For example, the tear strip 200 may include any number of tear lines, and each having any number of first lines of weakness and the second lines of weakness without as desired, and in accordance with the design constraints. Further, the tear strip 200 may be disposed at any desired angle around the housing 281, may be of a varying width, may have non-parallel perforation lines of weakness and may be placed at different elevations on the housing 281, as described. Further, the tear strip 200 may be formed in any possible dimensions in accordance with the of dimension of the sidewalls 282 and the utility and/or other design constraints related thereto, without deviating from the scope of the current disclosure.

Further, it is to be contemplated that the shipping box 281 as illustrated in FIGS. 1-5 is configured, when separated into two separate portions, namely 286, 287, each of the housing portions 286, 287 is generally equal in size and each adapted to store an equal amount of content therein. This embodiment, however, is not intended as a limitation. Therefore, it will be understood that, in an alternative embodiment, the housing 281 may be separate into two housing portions which are not equal in size. In any event, it will be appreciated that the tear strip 200 will be configured within the secondary package 280 as shown and/or described herein.

The secondary package 280, including the housing 281, the blank 290 and the tear strip 200 may be formed of a material selected from a single layer or a multilayer structure of any kind of paper, fiberboard, corrugated board, a plastic and/or metal foils or any hybrid material, and/or any combination thereof, suitable for the application in accordance with the current invention without deviating from the scope thereof.

FIGS. 2, 3 and 4 schematically show the arrangement of the basic components of the secondary package 280 employing the tear strip 200 of the present disclosure. However, in the construction of commercial functional units, secondary components such as couplers, connectors, support structure and other functional components known to one of skill in the field of packaging and more particularly the handling of packaging, may be incorporated within the secondary package 280. Such commercial arrangements are included in the present invention as long as the structural components and arrangements disclosed herein are present.

Figure 6:
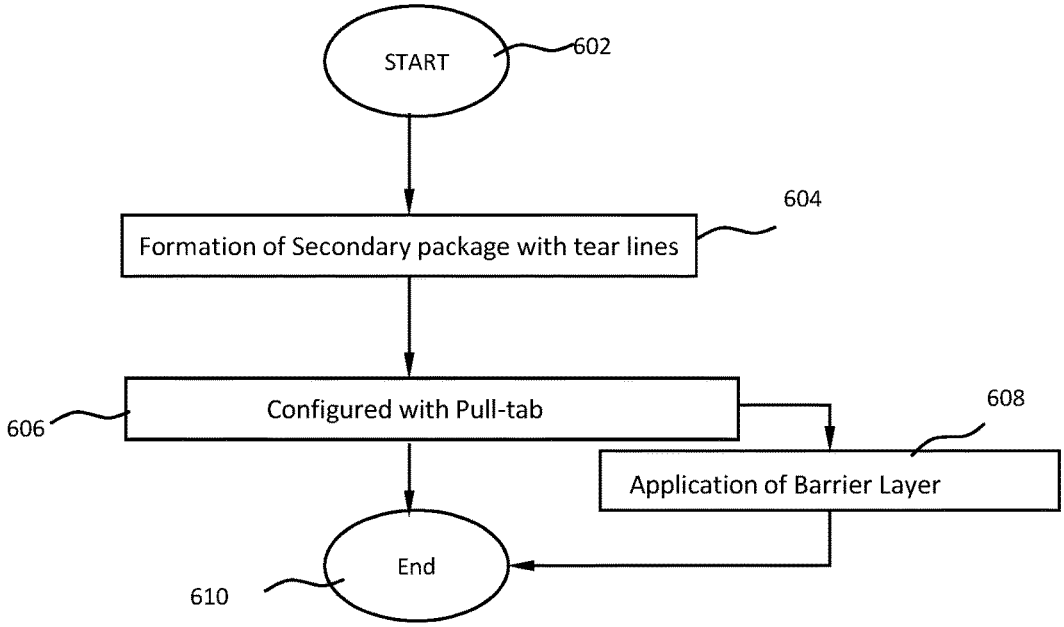
FIG. 6 depicts a flowchart illustrating the steps of manufacturing the secondary package having one or more tear strips, in accordance with an embodiment of the present disclosure.

FIG. 6 with reference to FIGS. 1 through 5, is a flow diagram illustrating a method 600 of manufacturing the tear strip 200 of the present disclosure. The method starts at step 602 and proceeds to step 604 where the carton 281 of the secondary package 280 is configured with two or more spaced apart tear lines 210, 220. In an embodiment the tear lines 210, 220 may be formed by removing housing material up to the predetermined depth, using one or more mechanically mechanisms/tools suitable such as a grooving channel, grooving tools, or the like, for forming grooves/perforations, and conventionally known in the art. However, in preferred embodiments, the tear lines 210, 220 may be formed during the process of die-cutting the blank of the corresponding carton. In yet other embodiments, the second line of weakness is formed by burning away the carton material up to the predetermined depth by means of laser radiations, or the like.

The method proceeds to an optional step 606 where the tear strip is configured with the pull-tab 260 at one of the ends thereof. The method 600 further includes an additional optional step 608 where a coating of barrier layer is applied onto each of the tear lines 210, 220 of the tear strip 200.

In an embodiment of the present invention, each of the step of the method 600 may be performed in any desired order, sequentially, and/or simultaneously.

INDUSTRIAL APPLICABILITY

The disclosure provides a secondary package 280 that can be readily split along a pre-selected line into a top part and a bottom section, the latter being useful as an attractive display tray having an aesthetically clean and smooth upper edges. Primarily, the secondary packaging is utilized for holding liquid containers, such as beer, wine, cider, hard liquor (e.g., distilled beverage, spirit, liquor, hard alcohol, etc.), soft drinks (e.g., cola, soda, pop, tonic, seltzer), iced tea, soda water and other types of carbonated/non-carbonated beverages a secondary package 280. However, it may be equally utilized for enclosing and securely carrying various items such as food items, house hold items, and any other group of items packed together as a group.

Further, the secondary package 280 with the tear strip 200, of the current disclosure, having a novel end structure which while being easy and cheap to make and set up, is adapted for quick, convenient opening to instantly reveal the contents and facilitate removal of the product, yet being able to withstand rough handling or accidental opening and is therefore very suitable for use by retail consumers, or by the retailers, and offers an a comfortable display, shipping, handling and transporting of packages of any shape, size or any variety of configurations.

The tear strip 200 of present invention is characterized to be incorporated within the secondary package 280 from the material of the package itself without additional elements, whereby the package when sealed will remain about moisture-proof and dust-proof, and which package may be conveniently opened by ripping the tear strip 200.

What is claimed is:

1. A tear strip configured onto one or more wall panels of a packaging blank, the tear strip comprising:
- a plurality of tear lines, wherein,
- one or more of the plurality of tear lines are adapted to be cut through at least one of the wall panels; each of the tear lines comprising:
  - a first line of weakness extending longitudinally from a first end towards a second end, the first line of weakness extending through an entire cross-section of the packaging blank;
  - a second line of weakness extending generally diagonally away from the first line of weakness in a direction away from a central longitudinal axis of the tear strip and towards the second end of the wall panel; the second line of weakness extending through a part of the cross-section of the packaging blank, such that the second line of weakness extends to a depth less than the entire thickness of the packaging blank,
  - wherein the first line of weakness comprising a first portion extending generally parallel to the central longitudinal axis of the tear strip and a second portion extending diagonally away from the first portion in a direction towards the central longitudinal axis of the tear strip.

2. The tear strip of claim 1, wherein the one or more of the plurality of tear lines comprising a first tear line spaced apart from a second tear line.

3. The tear strip of claim 2, wherein an axial line of second line of weakness of the first tear line intersects with an axial line of second line of weakness of the second tear line at the central longitudinal axis of the tear strip.

4. The tear strip of claim 1, wherein each of the one or more of the plurality of tear lines comprising two or more first lines of weakness, each extended towards a corresponding second line of weakness.

5. The tear strip of claim 4, wherein the second line of weakness of the first tear line is of a thickness about same as that of the second line of weakness of the second tear line.

6. The tear strip of claim 1, wherein the second line of weakness extends to a depth about half the thickness of the wall panel.

7. A secondary package comprising:
- a carton formed of a packaging blank having one or more wall panels;
- a tear strip configured onto at least one of the wall panels of the packaging blank, the tear strip comprising:
- a plurality of tear lines, wherein,
- two or more of the plurality of spaced apart tear lines are adapted to be cut through the panel; each of the tear lines comprising:
  - a first line of weakness extending longitudinally from a first end towards a second end, the first line of weakness extending through the entire cross-section of the packaging blank at the first line of weakness;
  - a second line of weakness extending generally diagonally away from the first line of weakness in a direction away from a central longitudinal axis of the tear strip and towards the second end of the wall panel, the second line of weakness extending through a part of the cross-section of the corresponding blank at the second line of weakness, such that the second line of weakness extends to a depth less than the entire thickness of the packaging blank,
  - wherein the first line of weakness comprising a first portion extending generally parallel to the central longitudinal axis of the tear strip and a second portion extending diagonally away from the first portion in a direction towards the central longitudinal axis of the tear strip,
- wherein the tear strip is torn by pulling the two or more of the plurality of tear lines together such that a generally clean cut through the cross-section of the packaging blank is achieved at each of the first line of weakness and the second line of weakness of each of the tear line.

* * * * *